US006771165B2

(12) United States Patent
Burg II et al.

(10) Patent No.: US 6,771,165 B2
(45) Date of Patent: Aug. 3, 2004

(54) CONTAINER COVER THAT GENERATES AUDIO OUTPUT

(76) Inventors: George Von Burg II, 3rd Floor, Victory Fty. Bldg., 16 Wong Chuk Hang Road, Aberdeen (HK); Harry D. Flagle, 3947 Eureka Dr., Studio City, CA (US) 91604-3110; Jerome J. Filiciotto, Filiciotto's Hilltop Farm, 404 Loma Larga Dr., Solana Beach, CA (US) 92075-1710

( * ) Notice: Subject to any disclaimer, the term of this patent is extended or adjusted under 35 U.S.C. 154(b) by 0 days.

(21) Appl. No.: 09/733,422

(22) Filed: Dec. 8, 2000

(65) Prior Publication Data

US 2002/0000908 A1 Jan. 3, 2002

Related U.S. Application Data

(60) Provisional application No. 60/170,193, filed on Dec. 10, 1999.

(51) Int. Cl.[7] ..... G08B 3/00

(52) U.S. Cl. ..... 340/384.1; 40/686.1; 40/540; 40/691.1; 40/692; 40/693; 40/384.3

(58) Field of Search ..... 340/384.1, 686.1, 340/540, 691.1, 692, 693, 384–3

(56) References Cited

U.S. PATENT DOCUMENTS

| | | | | | |
|---|---|---|---|---|---|
| 4,193,648 | A | | 3/1980 | Gargiulo | 312/9 |
| 4,398,491 | A | | 8/1983 | Fridl et al. | 116/67 R |
| 4,617,558 | A | | 10/1986 | Gin | 340/574 |
| 4,678,093 | A | | 7/1987 | Allen | 215/11 R |
| 4,688,023 | A | | 8/1987 | McGrill et al. | 340/545 |
| 4,711,368 | A | | 12/1987 | Simons | 220/450 |
| 4,756,222 | A | | 7/1988 | Armato | 84/1.01 |
| 4,801,929 | A | | 1/1989 | Instance | 340/692 |
| 4,845,470 | A | | 7/1989 | Boldt, Jr. | 340/540 |
| 4,847,597 | A | | 7/1989 | Dobosi et al. | 340/571 |
| 4,898,060 | A | | 2/1990 | To | 84/95.2 |
| 5,063,698 | A | | 11/1991 | Johnson et al. | 40/124.1 |
| 5,099,232 | A | | 3/1992 | Howes | 340/815.21 |
| 5,245,171 | A | | 9/1993 | Fox et al. | 235/492 |
| 5,439,103 | A | * | 8/1995 | Howes | 206/217 |
| 5,464,092 | A | | 11/1995 | Seeley | 206/217 |
| 5,489,893 | A | | 2/1996 | Jo et al. | 340/686 |
| 5,524,788 | A | * | 6/1996 | Plester | 220/522 |
| 5,536,196 | A | | 7/1996 | Sternberg | 446/81 |
| 5,575,383 | A | | 11/1996 | Seeley | 206/217 |
| 5,625,347 | A | * | 4/1997 | MacLean et al. | 340/568.1 |
| 5,653,353 | A | * | 8/1997 | Otto et al. | 215/306 |
| 5,796,328 | A | | 8/1998 | Golant | 340/384.1 |
| 5,813,563 | A | * | 9/1998 | Boehm et al. | 220/522 |
| 5,842,901 | A | | 12/1998 | Montgomery | 446/77 |
| 6,112,442 | A | | 9/2000 | Liang | 40/436 |
| 6,299,006 | B1 | * | 10/2001 | Samonek | 215/307 |
| 6,335,691 | B1 | * | 1/2002 | Bird | 340/691.1 |
| 6,545,594 | B1 | * | 4/2003 | knight et al. | 340/384.7 |

* cited by examiner

*Primary Examiner*—Daniel J. Wu
*Assistant Examiner*—Tai T. Nguyen
(74) *Attorney, Agent, or Firm*—Luce, Forward, Hamilton & Scripps, LLP

(57) ABSTRACT

A removable top for a bottle or other container includes a sound generator that is activated when the top is removed. The sound generator produces an entertaining audio signal that enhances experiences, such as eating experiences, undertaken at the time the bottle is opened. There are alternative ways of constructing the sound generator, such as with electrical switches, light sensors or the like.

4 Claims, 7 Drawing Sheets

CONTAINER COVER THAT GENERATES AUDIO OUTPUT

This Application claims BENEFIT of PROVISIONAL Application No. 60/170,193 FILED ON Dec. 10, 1999.

The present invention is directed to a bottle top device that generates music (such as a human voice singing a song) or other audio output.

BACKGROUND OF THE INVENTION

The public responds to, and enjoys, entertaining packages. Children and adults alike find pleasure in brightly colored labels, modern or distinct package shapes, and the like. Manufacturers are committed to producing such packaging because of the attention that they get on store shelves, in advertisements, etc., thereby increasing product awareness and/or product sales.

Some manufacturers have incorporated an audio presentation into their products. One conventional example of this is a greeting card that outputs an audio signal when it is opened. Another conventional example is a music box. Other manufacturers of common containers such as bottles and cans have also incorporated a limited audio presentation into their packaging.

U.S. Pat. No. 4,756,222 to Armato discloses a knob for attachment to the removable lid of a container, wherein the knob can be activated by a consumer to play an audio message. Similarly, U.S. Pat. No. 5,796,328 to Golant discloses a consumer product where the consumer takes appropriate steps to activate the audio message. These products have a shortcoming in that the consumer must proactively take certain steps to activate the audio message. This means that the consumer only hears the audio message if and when the consumer goes out of his/her way to take special steps to effect the activation of audio playback.

On the other hand, some containers with built-in audio playback will play audio automatically upon opening the container. For example, U.S. Pat. No. 4,845,470 to Boldt, Jr. discloses a tamper-evident bottle with a means for generating an audio signal located in its lid. In Boldt, Jr., the audio signal is heard the first time that the bottle is opened, so that the consumer will be aware that the lid of the bottle has not been previously opened, and that it is therefore unlikely that any tampering has taken place. Within the context of an audio signal directed to tamper status of the bottle, it would not make sense to play the audio message the second or subsequent time that the bottle is opened, because the integrity of the bottle's seal has already been compromised upon the initial (hopefully innocent) opening. Consequently, the bottle of Boldt, Jr. inhibits its audio signal upon any bottle opening that occurs subsequent to the initial opening of the bottle. U.S. Pat. No. 5,575,383 to Seeley likewise discloses a container that produces audio tones the first time, but only the first time, that the lid is removed.

U.S. Pat. No. 4,847,597 to Dobosi, et al. discloses a medicine bottle that sounds an audible alarm when its childproof cap is partially removed. The childproof cap and audio alarm device of Dobosi, et al. is disclosed for use in medicine bottles, where it works to provide an alarm signal every time the medicine is opened. Of course this is appropriate in the context of medicine bottles, because the contents are so dangerous that the annoyance of the alarm is outweighed by its utilitarian function in providing notice that children may be tampering with the dangerous medicine. The medicine bottle of Dobosi, et al. would not be applicable to bottles holding fruit stuffs and other non-dangerous consumer products (such as perfume) because: (1) its child-proof cap could interfere with access to the contents of the bottle; and (2) the alarm would not serve any sort of significant safety function.

SUMMARY OF THE INVENTION

The present inventors have developed a new and innovative way to entertain the users of consumer containers, and/or to attract attention to those consumer containers. The present invention, in its most basic form, is a bottle top which, when removed from the bottle to which it is attached, causes music or other types of aesthetically pleasing audio signals to be generated. The audio generator can be activated several different ways, and can be located on the product or, more preferably, within the top itself.

It is therefore an object of the present invention to provide a top or other cap, lid, etc., for a product which, when either removed from the product or when removal is attempted, generates sound. The present invention finds particular applicability to consumer-type products, such as food and drink bottles, where music is generated in order to entertain the user.

At least some embodiments of the present invention may exhibit one or more of the following objects, advantages and benefits:

(1) an aesthetically pleasing audio signal, when built in to a product's container, will attract consumers to the container and thereby help sell more product;

(2) an aesthetically-pleasing audio signal provides an opportunity to help establish audio trade dress that strengthens consumer association between the packaging and the product;

(3) a different aesthetically-pleasing audio signal built into a container may cause certain consumers to attempt to collect more of the containers, which would also result in more sales of the product that the container holds;

(4) the aesthetically-pleasing audio signal may incline certain consumers to keep the container even after the product is used up, thereby causing additional consumer exposure to the product's packaging, even after the time that the packaging would normally be thrown away or recycled; and (5) the aesthetically-pleasing audio signal may be utilized to convey positive messages about the container and/or the product held by the container.

According to one aspect of the present invention, a container includes a container member, a cover, an audio generator and an actuator. The container member defines an internal space and an opening located to allow access to the internal space through the opening. The cover is structured to removably cover opening in a substantially fluid-tight manner. The audio generator is structured to produce an audio signal upon activation, with the audio signal being entertaining in nature. The actuator is structured and located to automatically activate the audio generator at a least a first time the cover is at least partially removed from the opening and a second time the cover is at least partially removed from the opening. In other words, the audio generator does not generate sound one time only, upon only the initial removal of the cover.

According to a further aspect of the present invention, a container includes a top. The top includes a first housing portion, a second housing portion, a sound generator, a power source, at least two electrical contacts. The second housing portion is rotatable relative to the second housing portion. The sound generator produces sound when activated. The power source powers the sound generator. The two electrical contacts are operatively connected to the power source and to the sound generator. The contacts serve to supply power from the power source to the sound generator. One of said contacts is mounted on the first housing portion and the other contact is mounted on the second housing portion. Rotation of the first housing portion relative to the second housing portion moves the two contacts between non-actuation and actuation positions. In the actuation position, the contacts act to supply power from the power source to the sound generator. In the non-actuation position, the contacts do not to supply power from the power source to the sound generator.

According to a further aspect of the present invention, a container includes a top and a container member. The top is detachably attached to the container. The top includes a housing, a light sensing device and a printed circuit board. The light sensing device is located so that incident light on the light sensing device does not substantially change when the top is attached to the container and is motionless relative to the container. The printed circuit board is structured to selectively output an audio signal, with the light sensing device being electrically operatively connected to the printed circuit board so that a change in light incident on the light sensing device triggers the printed circuit board to output the audio signal.

Further applicability of the present invention will become apparent from a review of the detailed description and accompanying drawings. It should be understood that the description and examples, while indicating preferred embodiments of the present invention, are not intended to limit the scope of the invention, and various changes and modifications within the spirit and scope of the invention will become apparent to those skilled in the art.

BRIEF DESCRIPTION OF THE DRAWINGS

The present invention will become more fully understood from the detailed description given below, together with the accompanying drawings which are given by way of illustration only, and are not to be construed as limiting the scope of the present invention. In the drawings:

FIG. 2(*b*) shows a third embodiment of a bottle top according to the present invention, with the third embodiment being a variation on the second embodiment.

FIG. 3(*b*) shows a cross sectional view of the main housing of the second embodiment of FIG. 2(*a*).

FIG. 3(*c*) shows a cross sectional view of the lower housing of the second embodiment of FIG. 2(*a*).

FIG. 4(*b*) shows an elevated view of a fifth embodiment of a bottle top according to the present invention.

FIG. 4(*c*) is a side view of a bottle top that shows a preferred way of securing the housings of FIGS. 4(*a*) and/or 4(*b*).

FIG. 4(*d*) bottom view of the fourth embodiment bottle top of FIG. 4(*a*).

FIG. 4(*e*) shows a circuit diagram of the fourth embodiment bottle top of FIG. 4(*a*).

DETAILED DESCRIPTION OF THE PREFERRED EMBODIMENTS

Before starting a description of the Figures, some terms will now be defined.

DEFINITIONS

The present invention:

at least some embodiments of the present invention; references to various feature(s) of the "present invention" throughout this document do not mean that all claimed embodiments or methods include the referenced feature(s).

entertaining, entertainment: does not include alarms, warning or tamper indications.

Foodstuff: food and or drink, but medicines are not considered as foodstuffs. remove, removed: removed entirely or merely partially removed.

To the extent that the definitions provided above are consistent with ordinary, plain and accustomed meanings (as generally evidenced, inter alia, by dictionaries and/or technical lexicons), the above definitions shall be considered supplemental in nature. To the extent that the definitions provided above are inconsistent with ordinary, plain and accustomed meanings (as generally evidenced, inter alia, by dictionaries and/or technical lexicons), the above definitions shall control. If the definitions provided above are broader than the ordinary, plain and accustomed meanings in some aspect, then the above definitions will control at least in relation to their broader aspects.

To the extent that a patentee may act as its own lexicographer under applicable law, it is hereby further directed that all words appearing in the claims section, except for the above-defined words, shall take on their ordinary, plain and accustomed meanings (as generally evidenced, inter alia, by dictionaries and/or technical lexicons), and shall not be considered to be specially defined in this specification. Notwithstanding this limitation on the inference of "special definitions," the specification may be used to evidence the appropriate ordinary, plain and accustomed meanings (as generally evidenced, inter alia, by dictionaries and/or technical lexicons), in the situation where a word or term used in the claims has more than one alternative pre-established meaning and the specification is helpful in choosing between the alternatives.

DESCRIPTION OF PARTICULAR EMBODIMENTS

Figure 1:
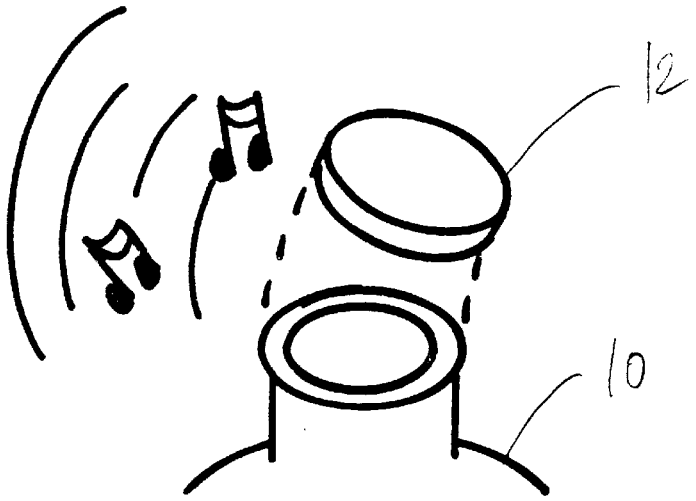
FIG. 1 shows an elevated view of a container and container top according to a first embodiment of the present invention.

FIG. 1 shows a bottle 10 and its associated top 12. The top 12 is a device that is used to seal the bottle 10 so that its contents, if any, will not escape. The subject invention can be applied to virtually any type of container made of virtually any type of material, such as glass or plastic or metal soda bottles, maple syrup containers, motor oil containers, aspirin bottles, etc. One preferred embodiment is to structure the container and top so that the seal between the container and the top is fluid-tight, such that the container can hold at least partially contents (e.g., syrup). For example, conventional music boxes are not suitable to hold liquid contents because music box tops do not form a sufficiently tight seal with the music box.

In FIG. 1, the bottle 10 is sealed with the top 12. The seal is preferably hermetic so that perishable contents, such as perishable foodstuff, will not spoil. Preferably, top 12 is threadably, removably attachable to the bottle. In operation, the user opens the bottle 10 by removing the top 12. When the top 12 is removed, music 14 or other entertaining sound is generated. Other entertaining sounds include sound effects, yodeling, applause, poetry, advertising, or the like. Entertaining sounds do not include any sort of alarm, tamper detection audio or product warnings, as these types of audio signals have a purpose that is completely different, and probably at odds with, entertainment.

Preferably, the sound generation is automatic such that the user does not need to take any steps to cause the sound generation, outside of the normal steps necessary to remove the top from the bottle. For example, if the top is threadably engaged with the bottle, then the user would only need to rotate the top relative to the bottle sufficiently to remove or partially remove the top from the bottle, without taking additional steps such as turning knobs or other winding mechanisms. In this way, the user's enjoyment of the audio program is enhanced, because there is no need to remember or execute tasks in order to hear the audio program. Rather, the user merely takes steps that would normally be taken to get at the contents of similar, conventional bottles that do not have any sort of audio generation mechanisms.

Figure 2A:
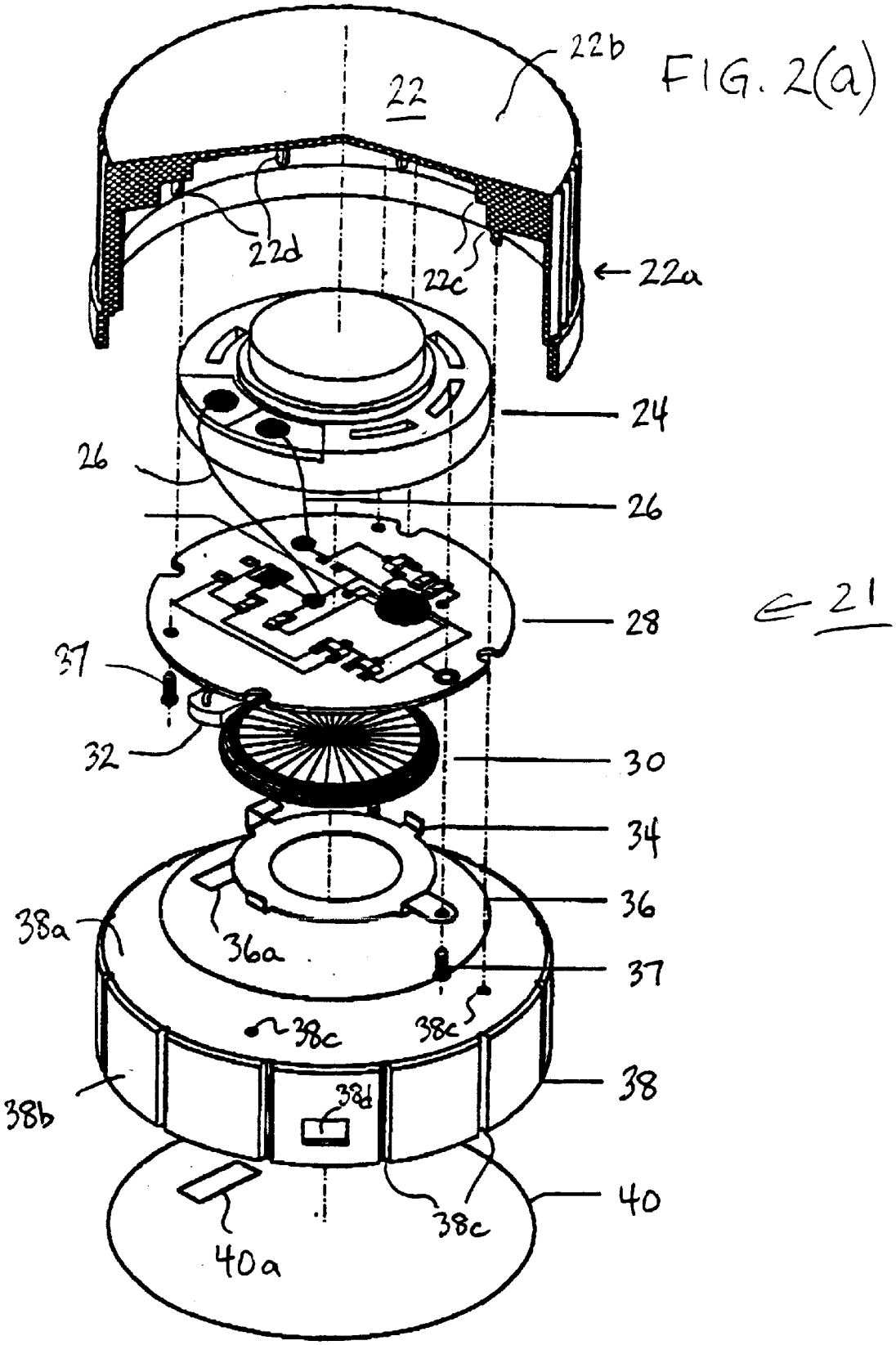
FIG. 2(*a*) illustrates partially-cut-away, exploded view of a second embodiment of a bottle top according to an embodiment of the present invention.
Figure 2B:
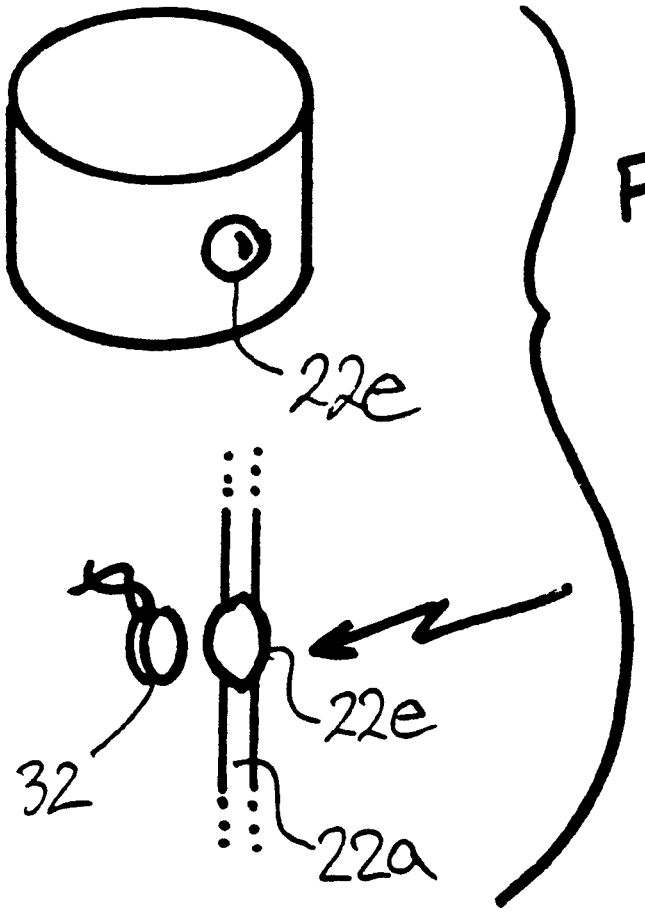

FIG. 2(*a*) illustrates an exploded view of a bottle top 21 according to a second embodiment of the present invention. A main housing 22 has a generally cylindrical outside shape and an internal cavity in which is formed a multi-tiered internal structure shaped to accommodate the components that generate the sound. As shown in FIG. 2(*a*), those components include a sound actuator 24 which is connected by lines 26 to a printed circuit board 28; a battery 30; and light sensor 32; a bridge plate 34; an electrically insulated plate 36; a lower housing 38; and a gasket 40. These components are all fixedly mounted within the internal cavity of the top.

The sound actuator 24 can be a thin, mylar speaker such as those of conventional construction available in the marketplace. However, it can be any other type of sound generator such as a piezoelectric transducer, a coil-driven speaker, etc. In FIG. 2(*a*), the sound actuator 24 is on the order of 15 mm in diameter and 4 mm thick, although the artisan will appreciate that different dimensions can be used depending on the size of the top being built.

A larger-diameter printed circuit board 28 overlies the sound actuator, and may contain holes in order to facilitate the transmission of sound through the top to the outside. In this regard, the main housing 22 may also be provided with holes, although the location of such holes might be dictated by the type of contents being held in the container (not shown). The risk is that the components 24 to 40 may not provide a sufficient seal against migration of the container's contents through the holes in the main housing 22 to the outside. However, if the components 24 to 40 are structured to provide a sufficient seal, then holes in the housing 22 are more preferable. Such holes can be distributed in the top planar surface 22*b* of the housing 22, and/or around its side 22*a*.

The battery 30 or other power source, such as a charged capacitor or solar cell, is secured between the printed circuit board 28 and a bridge plate 34. Bridge plate 34 is specially shaped to hold battery 30 securely. Bridge plate 34 may, but need not be, made of conductive material such as metal. If metal, it can act as a ground for the battery 30 and for the other electrical components of the invention.

An insulator plate 36 is fitted on the side of the battery opposite the printed circuit board 30 in order to provide an electrically isolated space for the battery 30. Insulator plate 36 can be a thin plastic sheet or other non-conductive material. As will be apparent to the artisan, the bridge plate 34 and insulator plate 36 could be integrated into a single piece if a ground plate is either not needed or located elsewhere in the structure.

Although glue or other securing means can be used to hold the components together, the embodiment of FIG. 2(*a*) uses screws 37 to secure the components to the main housing 22. Each of the printed circuit board 28 and the bridge plate 36 have through-holes defined therein for at least one screw 37.

The lower housing 38 has a generally planar surface 38*a* which acts together with the interior surfaces of the main housing 22 to create a cavity within which the components 24 to 37 are housed. The multi-tiered interior surface of the main housing 22 is defined by concentric steps 22*c* which lead from the edge 22*d* to the inside of the upper surface 22*b*. Each of the major components listed above fits into its own step 22*c* so that they cannot move laterally within the top. Likewise, the lower housing 38 fits into one of the steps, and is further secured by projections 22*d* which protrude downward from the top interior surface of the main housing 22, through through-holes provided in any of the intermediate components such as the printed circuit board 28 (as delineated by the broken lines of FIG. 2), and into slots or holes 38*c* in the lower housing 38.

In addition to, or as a substitute for, the projections 22*d*, the main housing 22 may include projections extending from the side wall 22*a* toward the interior of the top. In FIG. 2, these projections are shown as one or more vertical ridges which mate with elongated depression(s) 38*c* in the lower housing 38. The lower housing also preferably includes a detent 38*d* which co-acts with a depression (not shown) in the main housing 22 to assist in keeping the lower housing tight against the main housing 22.

Top 21 can be secured to the container by mechanical elements in the lower housing 38, and/or by mechanical elements in the main housing 22. For example, the lower housing 38 may be provided with spiral rings (e.g., threads) complementary to spiral rings on the container, so that the top is a "twist off" type of top. The top can also be a simple pull-off type of top, in which case detents in the housing 22 and/or 38 act to hold the top on the container. The type of removal mechanism and/or replacement mechanism is not critical to the operation of this embodiment. However, it is preferable to use a fluid-tight seal so that liquid or semi-liquid contents may be reliably held within the container.

The gasket 40 provides a barrier between the electrical components housed within the top, and the contents (if any) of the container. The gasket 40 is optional, and lies within a cavity of the lower housing 38.

In FIG. 2(*a*), the light source 32 acts as the trigger (or activator) for the sound actuator 24. The light source is mounted in a protected area of the top, but can "see" into the container through a window 36*a* in the insulator plate 36, a window (not shown) in the lower housing 38, and a window 40*a* in the gasket 40. Each of these windows could be holes, but it is preferred that at least one of them is a transparent or translucent material, one which can transmits light of the proper wavelength to the light sensor 32. It should be understood that the light sensor can be sensitive to whatever wavelength of ambient (not necessarily visible) light that is expected to exist in and around the container.

In operation, top 21 is secured to its container. The material of the container (or labeling on the container) is either opaque to the ambient light or, acting in concert with the contents of the container, blocks the ambient light from reaching the light sensor 32. When the user wishes to open the container he or she removes the top, thereby exposing the interior of the container, and thus the light sensor 32, to the ambient light. The ambient light causes the light sensor 32 to change state, which is either sensed by a controller on the printed circuit board 28 or acts to supply power the controller (like a closed switch).

The controller, in response, either supplies power from the battery 30 to the sound actuator 24 together with the musical notes to play, or simply provides the musical notes upon being powered up. Light sensor 32 thus acts as an ON/OFF switch to turn on the sound actuator 24, meaning that the loss of ambient light (e.g., when the top is replaced onto the container) may turn off the sound controller. The controller may be a SPEF40A sound controller available from Sunplus, which can be programmed to play music or other sounds from a Windows programming platform. (It is noted that the words Sunplus, Windows and/or SPEF40 may be subject to trademark rights.)

The artisan will appreciate that innumerable variations can be made to the specific implementation shown in FIG. 2(*a*). For example, as shown in FIG. 2(*b*), one or more windows 22*e* can be provided on the side surface 22*a* of the main housing (and possibly on the sides of the lower housing 38) so that the sound can begin before the top is fully removed from the container. If, for example, such a window is provided at the mid-point between the upper surface 22*b* and the lower edge of the main housing 22, then the sound actuator will be actuated when the top is approximately half-way off of the container. Thus, the present invention contemplates the "removal" of the top to include situations where the top is not completely removed, but rather removal has at least been initiated. Here, the window may include a convex or other lens that focuses ambient light onto the light sensor 32.

If the power source is a solar cell, the solar cell should be exposed to ambient light as the top is removed. The ambient light charges the solar cell so that, after the expiration of a charging period, power is generated and the sound generator is activated. The solar cell can remain charged after the top is replaced onto the container. The sound controller can also be programmed with an initial soundless period, so that the sound does not begin until a predetermined time after the top has been removed. This can be useful in surprising the user, anjd thereby enhancing the entertainment value of the audio program. Also, the time interval and or the selection of audio program itself can be made random, for further variety in the entertaining experience of removing the top from the bottle.

Figure 3A:
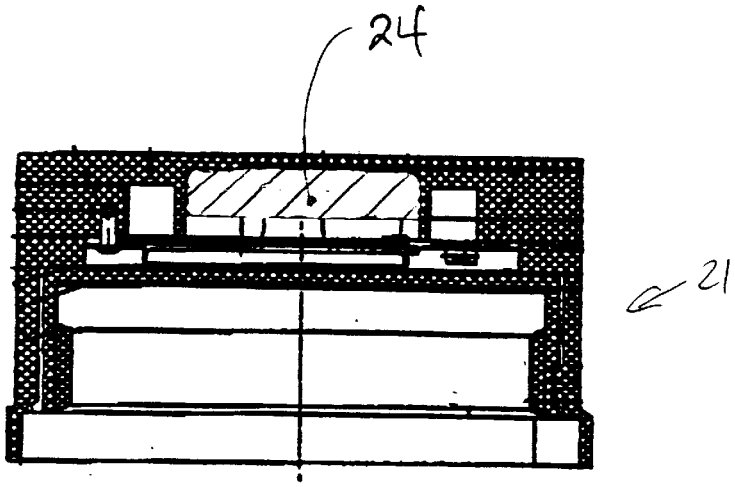
FIG. 3(*a*) shows a cross sectional view of the second embodiment of FIG. 2(*a*).
Figure 3B:
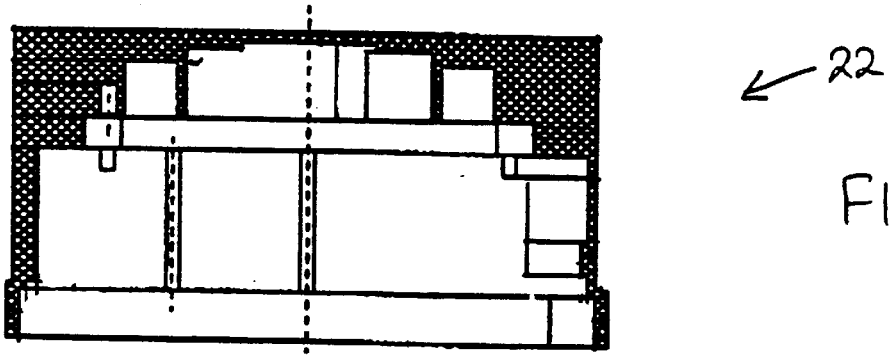
Figure 3C:
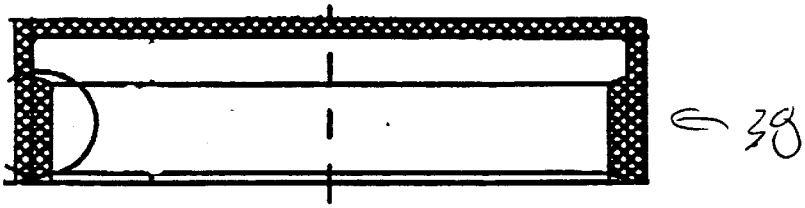
Figure 4A:
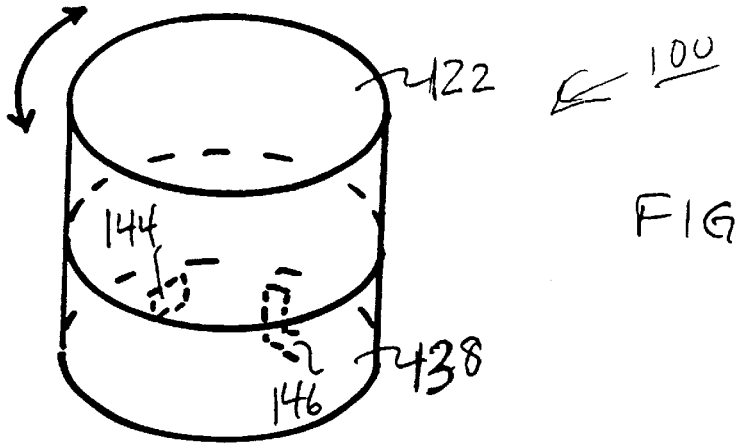
FIG. 4(*a*) shows a perspective view of a fourth embodiment of a bottle top according to the present invention.
Figure 4B:
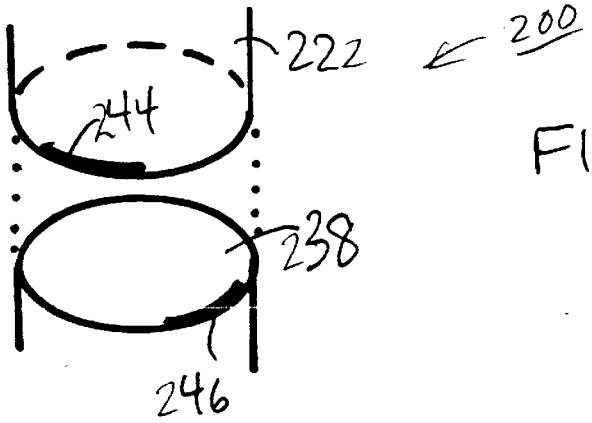
Figure 4C:
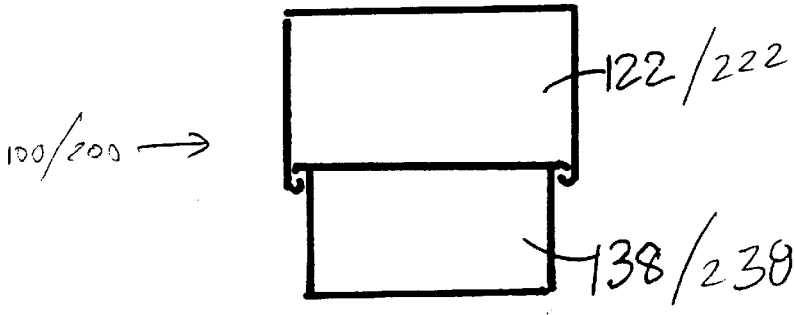
Figure 4D:
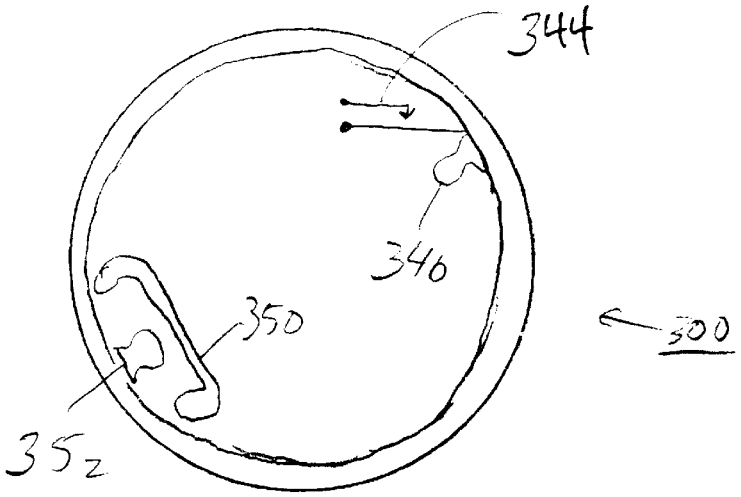
Figure 4E:
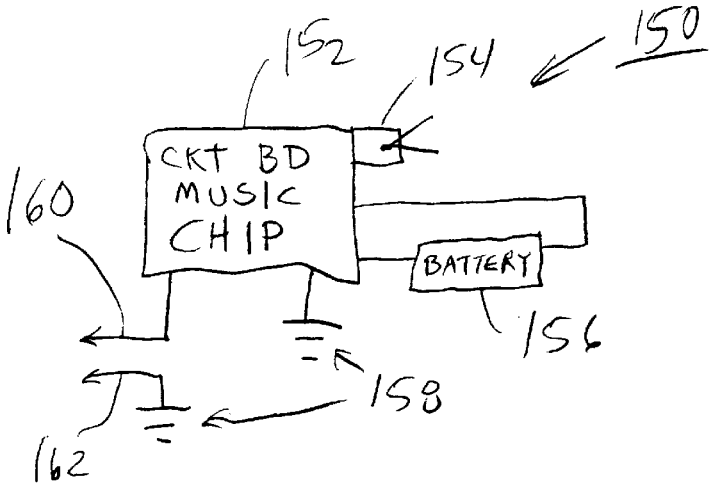

FIGS. 3(*a*) to 3(*c*) are cross-sectional views showing how to construct and assemble the top of FIG. 2(*a*). FIG. 3(*a*) shows a side view of the top of FIG. 2 in cross section, and in an assembled state. In this embodiment, its size is on the order of 44 mm in diameter, and 25 mm tall. The present invention, however, is not limited to any particular size or shape—the top can have a square cross section, and irregular shape, etc. FIG. 3(*b*) shows the same view as FIG. 3(*a*) but only includes the main housing 22. FIG. 3(*c*) shows a similar cross-section, but only includes the lower housing 38 for clarity of illustration.

FIG. 4(*a*) shows a fourth embodiment of a bottle top 100 according to the present invention. Top 100 includes similar components as described for top 21 of FIG. 2(*a*), but the main housing 122 is rotatable relative to the lower housing 138. The main and lower housings mate at a track that permits the relative rotation. The main housing and lower housing are respectively provided with contacts 144, 146 of a switch. When engaged the contacts 144, 146 cause power to be supplied from the battery to the sound actuator, thereby initiating the production of sound. A helical spring or other resilient element (not shown) can be provided internally or externally between the two housing pieces in order to cause the respective contacts 144, 146 to separate. This is particularly useful in embodiments in which the sound controller monitors the engaged/disengaged state of the contacts and only requires momentary engagement of the contacts in order to be activated.

As with top 21 of FIG. 2(*a*), the top 100 of FIG. 4(*a*) can employ screw threads on the lower housing to secure the top to its container, or the top can be a simple pull-off top having appropriate detents formed in the lower housing 38. The method and manner of removal and/or replacement of the top is not critical to the operation of this embodiment. However, in embodiments in which the top is a twist-off type of top, the user rotates the main housing 22 relative to the lower housing 38 until the contacts 144, 146 engage one another. Upon engagement, the sound controller begins supplying sound tones to the sound actuator.

In this way, the user is not required to take any action beyond the twisting motion that would otherwise be required to extricate the top from the bottle. Meanwhile, the user continues to rotate the main housing (e.g., in a counterclockwise direction) whereby the contact on the main housing presses against the contact of the lower housing with enough force to cause the lower housing to begin rotating relative to the container. The lower housing, having the spiral grooves that mate with the container, is thus twisted off.

FIG. 4(*b*) shows another embodiment of a bottle top 200 according to the present invention, which is a variation of previously explained top 100 of FIG. 4(*a*). In top 200, contact 244 is located on main housing 222 and contact 246 is disposed on lower housing 238. Again, the contacts are twisted into angular alignment to trigger the audio program. A further variation of FIG. 4(*a*) includes a lower housing that is held within the main housing 22, much like the design of FIG. 2(*a*), but wherein the two housings can rotate relative to one another but for the contacts. Top 200 is arranged so that top 200 can only be removed from a bottle (not shown) by grasping the lower housing 138 and twisting it. For example, contacts 144, 146 can be radially disposed relative to one another as shown in FIG. 4(*b*), such that engagement is made over a predetermined range of positions of the main housing 222 relative to the lower housing 238. At the same time, the main housing 222 is infinitely rotatable relative to the lower housing 238.

In both the tops 100 and 200, the main housing 122, 222 needs to be mated with the respective lower housing 138, 238. One possible mating system (generic to both tops 100 and 200) includes an interlocking-J shape, such as that shown in FIG. 4(*c*).

FIG. 4(*d*) shows bottle top 300, which is another variation, includes dedicated stops 350, 352 which do not act to turn on the sound, but rather to twist on or twist off the top from the container. In top 300, a separate pair of contacts 344, 346 generate the actuation signal used by the sound controller to activate the audio program.

FIG. 4(*e*) shows a circuit diagram for the audio circuitry 150 of bottle top 100. The circuitry includes circuit board music chip 152, speaker 154, batter 156, grounds 158, electrical line 160 and electrical line 162. Electrical line 160 leads to contact 144, while electrical line leads to contact 146. When the two contacts 144, 146 come into contact, circuit board music chip 152 starts the audio program through speaker 154. The audio program preferably lasts only for a predetermined interval, but will restart when contact is again made.

Figure 5:
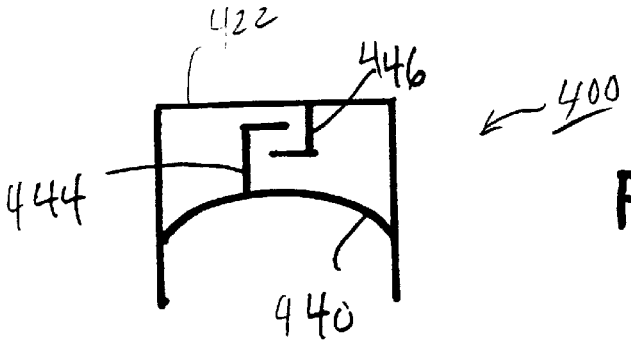
FIG. 5 shows a seventh embodiment of a bottle top according to the present invention.

FIG. 5 shows bottle top 400 according to the present invention. In FIG. 5, two contacts 444, 446 are respectively disposed on gasket 440 and on a stationary part of housing 422. Gasket 440 is flexible and is shown in a deflected position due to pressurization inside the container (not shown). Top 400 is suitable for soda or other contents that create or are simply stored under pressure. When top 400 is removed to a point where the pressure is released, the resultant deflection of gasket 440 ceases, thereby allowing the gasket to move to a more-relaxed planar orientation. Contact 444 on gasket 440 is thereby caused to move downward so that it comes into contact with the other contact 446 on disposed on housing 422. Similar to the circuitry explained above in connection with FIG. 4(*e*), sound is activated by contact between the two contacts.

Figure 6:
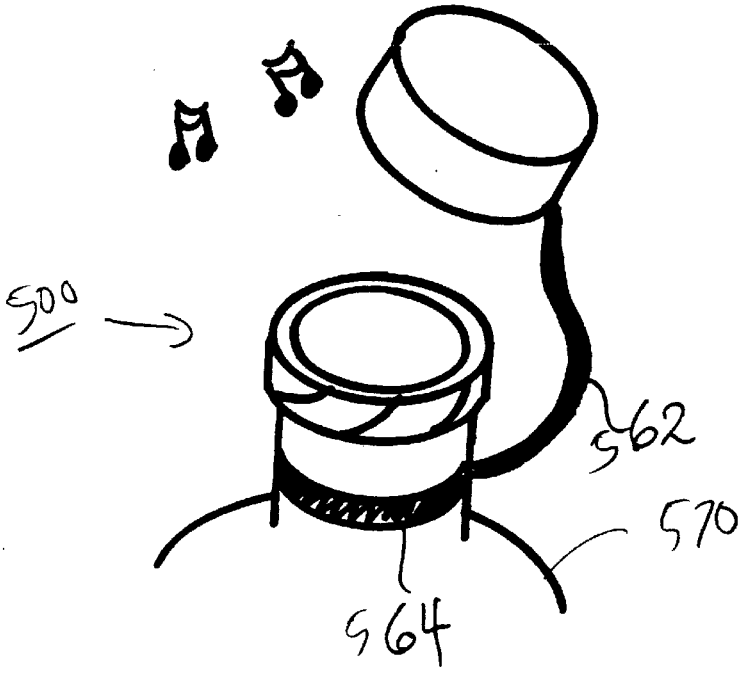
FIG. 6 shows an eighth embodiment of a bottle top according to the present invention.

FIG. 6 illustrates an another embodiment of a bottle top 500 and container 570 according to the present invention. In top 500, some of the electronic components described in relation to FIG. 2 are mounted on the container rather than on or in the top itself. Top 500 is essentially removed from the container, but is connected by a connector 562 to a collar 564. Collar 564 can be glued to container 570, or it can be free to rotate about the neck of container 570. In either case, collar 564 contains some or all of the components shown in FIG. 2. In one embodiment, the battery is stored in the collar, with power being fed through the connector 562 to the top.

Figure 7:
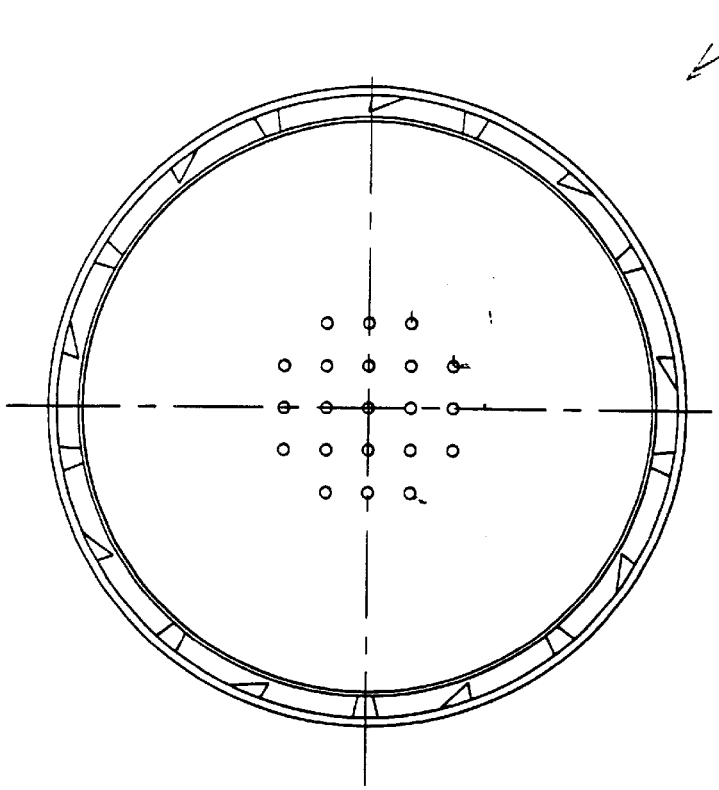
FIG. 7 shows a top view of a ninth embodiment of a bottle top according to the present invention.
Figure 8:
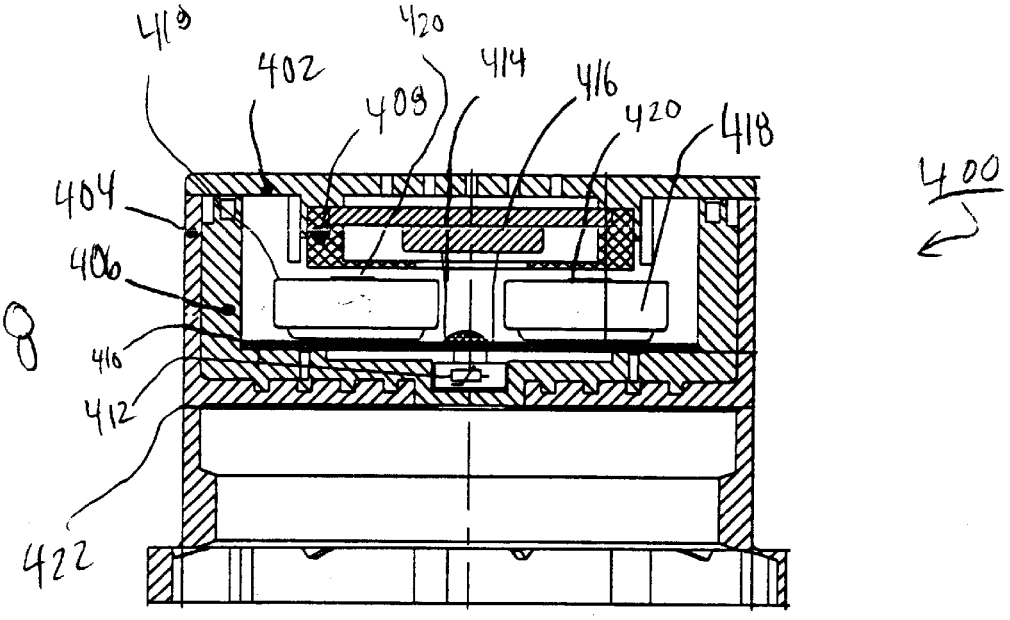
FIG. 8 shows a cross-sectional view of the ninth embodiment bottle top of FIG. 7.

FIGS. 7 and 8 show a bottle top 400 according to another embodiment of the present invention. Bottle top 400 includes housing portion 402, housing portion 404, housing portion 406 and housing portion 408, printed circuit board ("PCB") 410, light sensing circuit 412, audio link 414, speaker 416 and batteries 418. The various portions of the housing 402, 404, 406 and 408 fit together to secure the other components. PCB 410 secures batteries 418 and circuitry to generate an entertainment audio program.

Light sensing device 412 is located to detect changes in incident light. Preferably, light sensing device is located so that incident light will not change unless and until top 400 is wholly or at least partially removed from a bottle (not separately shown). Preferably, light sensing device 412 uses correlated double sampling so that it can operate more accurately in low light conditions. This is advantageous because ambient light inside a bottle top is usually pretty low. Light sensing device 412 communicates with the circuitry of PCB 410, so that when it detects a change in incident light, PCB 410 responds by outputting its audio program(s).

The audio program generation circuitry of PCB 410 is sent to speaker 416 by audio link 414. Speaker 416 and the other circuitry is powered by batteries 418, which have metal top panels 420. Preferably, the batteries are LR41 batteries.

The invention having been thus described, it will be obvious that the same may be varied in many ways not only in construction but also in application. For example, the sound generated by the invention can act as an alarm for the purpose of warning the user or someone else within earshot of the sound, such as a parent being warned when a toxic bottle has been opened. Although one embodiment described above is suitable for use with an opaque container, or at least a container that acts in concert with its contents to block light from reaching a light sensor, it should be understood that the present invention may be used with transparent and translucent containers as well. The contacts described above can also be placed on the separate pieces of childproof safety caps that are commonly used with pharmaceutical or other pills, i.e., those caps that must first be depressed before they can be twisted off of their container. Such variations are not to be regarded as a departure from the spirit and scope of the invention, but rather as modifications intended to be encompassed within the scope of the following claims.

Many variations on the above-described container covers are possible. Such variations are not to be regarded as a departure from the spirit and scope of the invention, but rather as modifications intended to be encompassed within the scope of the following claims, to the fullest extent allowed by applicable law.

What is claimed is:

1. A container comprising a top comprising:

a first housing portion;

a second housing portion rotatable relative to the first housing portion;

a sound generator for producing sound when activated;

a power source for powering said sound generator; and at least two electrical contacts operatively connected to said power source and to said sound generator, for supplying power from said power source to said sound generator, wherein a first one of said contacts is mounted on said first housing portion and a second one of said contacts is mounted on said second housing portion;

wherein rotation of said first housing portion relative to said second housing portion moves said first and second contacts between non-actuation and actuation positions, said actuation position acting to supply power from said power source to said sound generator, and said non-actuation position acting not to supply power from said power source to said sound generator.

2. The container of claim 1 wherein the contacts are located and shaped to be in physical contact when in the actuation position.

3. A The container of claim 1 wherein the sound generator is programmed to produce an audio program that is entertaining in nature.

4. The container of claim 3 wherein the audio program comprises at least one of the following: music, singing, sound effects, yodeling, applause, poetry and advertising.

* * * * *